US008550846B2

(12) United States Patent
Nachbauer et al.

(10) Patent No.: US 8,550,846 B2
(45) Date of Patent: Oct. 8, 2013

(54) COUPLING PART FOR ELECTRICAL LINES

(75) Inventors: Otto Nachbauer, Floβ (DE); Martin Voit, Moosbach (DE); Rainer Lang, Georgenberg (DE)

(73) Assignee: Nexans, Paris (FR)

( * ) Notice: Subject to any disclaimer, the term of this patent is extended or adjusted under 35 U.S.C. 154(b) by 49 days.

(21) Appl. No.: 13/362,163

(22) Filed: Jan. 31, 2012

(65) Prior Publication Data

US 2012/0184128 A1 Jul. 19, 2012

(30) Foreign Application Priority Data

Jan. 25, 2010 (EP) ..... 12 305 090
Feb. 2, 2011 (EP) ..... 11 305 103

(51) Int. Cl.
*H01R 13/58* (2006.01)

(52) U.S. Cl.
USPC ..... 439/606

(58) Field of Classification Search
USPC ..... 439/606, 604, 736
See application file for complete search history.

(56) References Cited

U.S. PATENT DOCUMENTS 6,957,981 B2 * 10/2005 Karino et al. ..... 439/606
6,981,897 B2 * 1/2006 Sakatani ..... 439/606
7,121,899 B2 * 10/2006 Homann et al. ..... 439/680
8,029,318 B2 * 10/2011 Namiki et al. ..... 439/606
8,449,328 B2 * 5/2013 Ooki ..... 439/606
2007/0293087 A1 * 12/2007 Kennedy et al. ..... 439/606
2010/0190377 A1 7/2010 Islam
2012/0225582 A1 * 9/2012 Smutny et al. ..... 439/587

FOREIGN PATENT DOCUMENTS

DE 3417811 10/1985
DE 4202813 4/1993
DE 102006049703 4/2008
DE 202009003546 7/2010

OTHER PUBLICATIONS

International Search Report dated Jul. 25, 2011.

* cited by examiner

*Primary Examiner* — Neil Abrams
*Assistant Examiner* — Phuongchi T Nguyen
(74) *Attorney, Agent, or Firm* — Sofer & Haroun, LLP

(57) ABSTRACT

A coupling part for electrical lines, where, in an injection-molded protective or plug body, in whose first end a cable is guided, a sealing element is contained which rests circumferentially tight against the cable. The sealing element is surrounded by a capsule part and is biased by the capsule part at least proportionately against the cable, wherein the capsule part is surrounded at least proportionately by the injection-molding protective or plug body.

15 Claims, 2 Drawing Sheets

COUPLING PART FOR ELECTRICAL LINES

RELATED APPLICATION

This application claims the benefit of priority from European Patent Application Nos. EP 11 305 103.1, filed on Feb. 2, 2011 and EP 12 305 090.8, filed on Jan. 25, 2012, the entirety of which are incorporated herein by reference.

BACKGROUND

1. Field of the Invention

The present invention relates to a coupling part for electrical lines and a coupling part according to the invention with an electrical line connected thereto, and a method for arranging the coupling part in the electrical line, or, respectively, a method for manufacturing a coupling part with an electrical line connected thereto. Such a coupling part, also called plug, has a contact for individual conductors of a connected cable, wherein the contact is arranged in a recess or bore of a contact carrier. The contacts arranged in recesses of the contact carrier, which are separate from each other, are accessible from a contact side of the contact part and are contacted by the conductors on the oppositely located connection side of the contact carrier. The conductors, including a section from which a casing has been removed, preferably including a cable section with casing, are surrounded by an injection-molded protective or plug body which may border the connection side of the contact carrier and/or may optionally surround the contact carrier over sections thereof or completely. Optionally, the contact carrier may be constructed as a single piece with the injection-molded protective or plug body and may be manufactured, for example, by injection-molding the substance which forms the injection-molded or plug body, section by section, directly in an injection-mold.

The coupling part according to the invention is distinguished by the fact that it has at the end at which the line enters the coupling part, a water-tight guidance of the line.

2. Description of Related Art

DE 3417811 C1 describes a method for mounting a coupling part at the end of an electrical line in which the coupling part is manufactured by injection-molding a section of the cable and the contact carrier connected thereto.

This known coupling part has the disadvantage that a water-tight connection between the line and the housing of the coupling part cannot be easily obtained, but only when the injection-molding material enters into an integral connection with the cable casing.

DE 10 2009 003 546 U1 describes a sensor with a housing which is injection-molded around a connecting cable which is guided in a sleeve. Within the sleeve, the injection-molding substance presses an elastic V-shaped sealing member which is slidable within the sleeve against an O-ring which is surrounded by the sleeve and is placed on the cable.

DE 42 02 813 C1 describes a plug whose contact side is formed by a plug housing. Opposite the contact side, the plug housing is connected to a threaded member, which is sealed off relative to the cable casing as a result of an O-ring being biased by the threaded member against the cable casing. The threaded member is surrounded by and injection-molding substance which contacts the O-ring. The O-ring can be protected against the penetration of injection-molding substance by a second O-ring arranged at the cable casing in a groove of the threaded member.

OBJECT AND SUMMARY OF THE INVENTION

It is the object of the invention to make available an alternative coupling part and a method for the manufacture thereof, or, respectively, for arranging the coupling part in a cable, wherein, in particular, a water-tight guidance of the cable casing in the coupling part is obtained.

In the preparation of the invention, it has been found that a water-tight connection between the material, from which the housing of the coupling part is manufactured by injection-molding at the contact carrier and around the cable, can only be achieved if the injection-molding substance enters into an integral connection with the casing of the cable. This is particularly not the case in high temperature-resistant casing materials, such as, for example, in electrical line casings of FEP (fluorized ethylene-propylene copolymer) or line casings with or of radiation cross-linked polymer, for example, radiation cross-linked polyurethane (X-PUR) or radiation cross-linked polyethylene (XPE) if, for example, PA or PUR are used as injection-molding substance.

The invention meets this object with the features of the Claims and, particularly, with a coupling part having at least one contact in an injection-molded protective or plug body in whose first end is guided a cable which particularly has a casing of high temperature-resistant material, wherein the injection-molded protective or plug body has at its first end a sealing element placed circumferentially tightly against the casing of the cable, particularly a sealing element surrounding the casing with frictional engagement and/or so as to be integrally connected, wherein the sealing element is surrounded by a capsule part which is surrounded at least proportionally by the protective or plug body. The sealing element is surrounded by a capsule part and is biased by the capsule part against the cable. The sealing element may be a single-piece or multiple-piece sealing ring. For the purposes of the invention, the sealing element is also called a sealing ring as a representative term.

The at least one contact is secured in a recess of a contact carrier which is formed by the injection-molded protective or plug body, or in a recess of a contact carrier which is surrounded by the injection-molded protective or plug body, with the exception of an inlet opening to the at least one contact at least proportionally, preferably completely, by the injection-molded protective or plug body. Optionally, a contact carrier which is not connected as a single piece with the injection-molded protective or plug body is integrally connected to the injected-molded protective or plug body. The at least one contact can be hollow, so that a counter contact can be slid in from the inlet opening, and/or the at least one contact is in its section of the injection-molded protective or plug body adjacent the inlet opening, which is located at the second end of the protective or plug body opposite the first end, surrounded at a distance by the plug body, so that a counter contact can be slid on around the contact. The cable surrounded by the injection-molded protective or plug body preferably has a casing of temperature-resistant polymer, wherein the casing has no integral connection with the injection-molded protective or plug body. Opposite the first end of the injection-molded protective or plug body, the second end, which is located adjacent the contact carrier, or circumferentially surrounds the latter section by section. Alternatively, the plug body can at its second end form the contact carrier. The cable has at least one strand, preferably at least two or three strands, which may be insulated electrical conductors and/or insulated optical conductors, which are conductively connected to the contacts on the contact side of the contact carrier.

In accordance with the invention, the sealing ring is placed with its inner surface with a frictional connection or integrally connected on the casing of the cable, or around the complete circumference of the cable casing, and is on its oppositely located outer surface, and additionally on one or both of its end faces, which connect its inner surface to the outer surface, encapsulated or surrounded by the first capsule part and the second capsule part.

The sealing ring is dimensioned in such a way or has such an inner cross section that it can be arranged with frictional engagement around a section of the cable casing, so that it surrounds the casing of the cable with frictional engagement and preferably is placed with its inner surface around the entire circumference on the casino.

The sealing ring is surrounded with frictional engagement by a first section of a first capsule part, wherein this first section of the first capsule part biases the sealing ring against the cable arranged therein and extends over the axial length assumed by the sealing ring, preferably, over the axial length which is assumed by the sealing ring in its state biased against the cable casing. In this manner, the sealing ring produces a frictionally engaging longitudinal sealing effect along the cable. This first section of the first capsule part can, with an end face at its end, abut the optional second capsule part. Against the end face of the first capsule part, which faces the second capsule part or abuts an end face of the second capsule part, the first capsule part preferably has a second section which has a smaller internal cross-section than its first section, so that the second section of the first capsule part rests with its end face against an end face of the sealing ring, particularly against the end face of the sealing ring which is located opposite the second capsule part.

The coupling part has an injection-molded protective or plug body in whose first end is guided a cable whose oppositely located second end borders a contact carrier with at least one recess and a contact arranged therein, or has a contact carrier with at least one recess and a contact arranged therein, or a contact carrier and at least one recess and a contact arranged therein which on the connection side of the contact carrier is connected to a conductor of the cable, wherein a sealing element is placed circumferentially tightly on the casing of the cable, the sealing element is surrounded by a first section of a first capsule part and is biased against the casing of the cable, and a second capsule part, which surrounds the casing with positive and/or frictional engagement, arranged so as to border with an end face against an end face of the first section of the first capsule part, and against the sealing element, and the injection-molded protective or plug body surrounds the first capsule part and the second capsule part at least over sections thereof, and is connected to this second capsule part so as to be tight with respect to moisture, or consists thereof. In embodiments in which the coupling part consists of the injection-molded protective or plug body, the first capsule part and the sealing element surrounded by the first capsule part, and the second capsule part which is arranged around the cable casing and contacts connected to the conductors of the cable, the coupling part borders the contact carrier with an integral connection, or the contact carrier is constructed in a single piece with the injection-molded protective or plug body, wherein the seal between the injection-molded protective or plug body and the cable casing consists of the sealing element placed on the cable and arranged between the first and second capsule parts, particularly in a cable casing of casing material which does not enter an integral connection with the injection-molded protective or plug body.

A first capsule part is preferably arranged colinearly with the second capsule part, so that the first and second capsule parts comprise immediately adjacent sections along their common longitudinal axis in which the cable is arranged.

The second capsule part has an inner cross-section which is, for example, cylindrical, which is at least equal to or greater than the inner cross-section of the sealing ring, so that the second capsule part has an inner cross-section which is at least equal to or greater than the adjacent casing section of the cable arranged therein. In this manner, in the manufacturing method, the second capsule part can be slid onto the section of the cable casing which is located adjacent the casing section surrounded by the sealing ring.

The first and second capsule parts are preferably circumferentially closed to be slid axially onto the cable; however, the capsule parts can have an axial opening so that they can be slid onto the cable radially.

In accordance with the invention, the sealing ring is surrounded by a first section of a first capsule part and is biased radially against the casing of the cable, wherein preferably the end faces of the sealing ring are arranged between an end face of the second capsule part and an end face of a second section of the first capsule part, and preferably the end faces of the sealing ring are arranged between an end face of the second capsule part and an end face of the second section of the first capsule part by frictional engagement and/or positive engagement.

The inner cross-sections of the first capsule part and the second section of the first capsule part and the inner cross-section of the sealing ring are each cylindrical and arranged around a common longitudinal center axis. A cable is arranged along this common axis from the second capsule part, the second section of the first capsule part and the sealing ring arranged between the capsule parts, wherein the sealing ring is circumferentially surrounded by the first section of the first capsule part. Since the first section of the first capsule part circumferentially surrounds the sealing ring, this first section of the first capsule part biases the sealing ring against the casing of the cable. Because of the preferred arrangement of the sealing ring between an end face of the second capsule part and an end face of the second section of the first capsule part, the sealing ring is secured against axial displacement.

The second capsule part is preferably arranged in the direction toward the second end of the coupling part and the adjacent first capsule part is arranged in the direction toward the first end of the coupling part. Alternatively, the second capsule part can be arranged at the first end of the coupling part and the adjacent first capsule part in the direction toward its second end.

Optionally, a portion of the second capsule part, preferably a portion of the first capsule part, can protrude above the first end of the coupling part or of the first end of the injection-molded protective or plug body, wherein preferably the first section of the first capsule part has an inner cross-section which surrounds a cable arranged in the inner cross-section with frictional engagement and protrudes above the first end of the coupling part or of the injection-molded protective or plug body.

Since the first and second capsule parts contact each other at end faces, they are stable under the pressure of the injection-molding substance, so that the sealing element is not axially deformed during injection-molding. In accordance with the invention, the first and second capsule parts preferably have sufficient stability with respect to deformations caused by the pressure occurring during injection-molding of the protective or plug body. The pressure in the mold during injection-molding can be 150-250 bar, particularly 150-200 bar, at the temperature of the flowable injection-molding substance of the protective or plug body, for example, at 180 to 320° C. The first and second capsule parts are preferably arranged at their end faces so as to be tight relative to the injection-molding substance, so that during injection-molding the injection-molding substance cannot penetrate between the first and second capsule parts.

This positively and/or frictionally engaging or tight arrangement of the first and second capsule parts relative to the cable casing and the stability of the first and second capsule parts relative to the pressure occurring during injection-molding of the protective or plug body protect the sealing element against deformation and against contact with the injection-molding substance and maintains the tightness relative to the casing established by the sealing element. This stability of the first and second capsule parts is obtained by the geometry, wall thickness and by the material of the first and second capsule parts. The selection of a compatible geometry, particularly of a wall cross-section or wall profile, as well as of a wall thickness for a material of the first and second capsule parts for stability which is sufficient under the pressure occurring during injection-molding of the protective or plug body, in order to prevent the permanent deformation of the first and second capsule parts and the penetration of injection-molding substance into the sealing element composed of the first and second capsule parts, can be carried out as is customary in the art.

Preferably, the second section of the first capsule part and the second capsule part are arranged on both sides of the sealing element with positive and/or frictional engagement relative to the cable casing, for example, with frictional engagement around the complete circumference of the cable casing so that while injection-molding is carried out, the injection-molding substance cannot penetrate to the sealing element. In particular, the first and second capsule parts have cylindrical recesses which form a press fit or a clamping fit relative to the cable, which prevents penetration of the injection-molding substance up to the sealing element at temperature and pressure of injection-molding. Such a fit may have for example, a recess which has a tolerance or a distance of max. 0.2 mm, preferably max. 0.01 mm more preferred max. 0.08 to max. 0.01, or up to max. 0.02 to max. 0.05 mm from the cable casing. The cylindrical recesses of the first and second capsule parts may have an axial length of, for example, 1 to 20 mm, preferably 3 to 15 or up to 10 mm. The recesses of the first and second capsule parts preferably have the same diameter.

The first and/or second capsule part is preferably comprised of a material which, when injection-molded with the material for the injection-molded protective or plug body, enters into an integral connection with the injection-molding substance, for example, the first and/or second capsule part may be of PA (polyamide) and/or PBT (polybutylene terephthalate) and the injection-molding material may be, for example, a polymer mixture on the basis of polyamide and/or polyurethane. An integral connection preferably has such strength that it is stable under a tensile load, for example, a load over a surface area of 0.1 to 10,000 Pa, particularly 1 to 1,000 Pa, or in the stripping test, at 1 to 10,000N, particularly 10 to 1,000N per cm. width of the connecting surface, especially longitudinally water-tight.

The casing of the cable preferably is of a material which does not enter into an integral connection with the injection-molding material, particularly of a material with a content of or consisting of high temperature-resistant material, for example, of FEP, XPUR or XPE. In accordance the invention, the coupling part consists of injection-molding material which, at least in the injection-molded section in which it at least proportionately surrounds the first and second capsule parts and which extends in particular from the entry of the cable into the coupling part up to the contact carrier, wherein, in accordance with a further preferred feature, the injection-molding material, enters into an integral connection with the outer surface of the first capsule part and/or the outer surface of the second capsule part, further comprising first and second capsule parts and the sealing element surrounded by the capsule parts, as well as a section of the cable and the strands thereof. In this embodiment, the first capsule part is fixed with its end face against the adjacent end face of the second section of the second capsule part, such that the first and second capsule parts are surrounded integrally by the injection-molded protective or plug body which is located adjacent the contact carrier and optionally surrounds the contact carrier proportionately, or forms the contact carrier as a single piece. Alternatively and in addition to the integral connection between the material of the injection-molded protective or plug body and the first and/or capsule part, the first and second capsule parts can be connected to each other, particularly in engagement with each other, for example, in frictional engagement with each other and/or through a positive engagement with each other, for example, pressed, locked or screwed together by frictional engagement, or glued or welded to each other particularly ultrasound welded to each other.

The connection between the first and second capsule parts may consist of, for example, adjacent end faces of the second capsule part and the first section of the first capsule part.

A coupling part according to the invention with a cable connected thereto has at its first end a cable guided over sections in the injection-molded protective or plug body, wherein the cable is surrounded by a second capsule part arranged around the cable casing and an adjacent first capsule part arranged around the cable casing, wherein the sealing ring is preferably arranged between a portion of the end face of the second capsule part and an end face of a second section adjacent the first section of the first capsule part, or is enclosed between these end faces, more preferred by frictional engagement between these spaced apart end faces of the second capsule part and a first section of the first capsule part.

The method for manufacturing a coupling part with a cable connected thereto includes in addition to contacting of the conductors contained in the cable with contacts which are arranged optionally in recesses of an additional or separate protective or plug body or a contact carrier to be formed as a single piece with the protective or plug body, wherein the contact carrier is arranged at the second end of the coupling part, arranging a sealing ring of the first capsule part and a second capsule part adjacent the first capsule part, around the cable, wherein the first section of the first capsule part encloses the sealing ring and biases the sealing ring radially over the entire circumference against the casing of the cable. The sealing ring is preferably arranged between the second capsule part and the second section adjacent the first clamped between a second capsule part and a first section of the first capsule part. Preferably, first the sealing element in the second section of the first capsule part is mounted and the second capsule part is arranged against the first capsule part and is connected therewith, wherein the first and second capsule parts and the enclosed sealing element form a common cylindrical recess. Subsequently, the cable is mounted in the cylindrical recess formed by the first and second capsule parts and the sealing element enclosed by the capsule parts, for example, by sliding the cable into this recess. The protective or plug body is manufactured by injection-molding at least a portion of the first and second capsule parts, particularly of the first section of the first capsule part, up to at least adjacent the contact carrier using a cross-linkable or hardening plastic material substance which enters into an integral connection with the injection-molded sections of the outer surfaces of the first and/or second capsule part.

In particular, the method for manufacturing the coupling part may include the following steps:

Making available a cable with a casing which is composed especially of high temperature-resistant material, for example, FEP, XPUR or XPE, arranging a sealing ring with its inner surface with frictional engagement and/or positively locking engagement around a section of the casing, arranging a first capsule part which encloses the cable, wherein a first section of the first capsule part surrounds the sealing ring and presses the sealing ring radially against the casing, preferably in such a way that the end face of a second section adjacent the first section of the first capsule part rests against an end face of the in combination with the arrangement of a first capsule part, arranging a second capsule part which encloses the cable around a section of the casing adjacent the sealing ring, preferably with an end face of the second capsule part resting against an end face of the sealing ring and/or resting against an end face of the first section of the first capsule part and preferably resting against the end face of the sealing ring located opposite the first capsule part, previously or subsequently, removing the insulation of at least one strand of the cable and contacting the conductor with a contact, or alternatively, wherein the contact is arranged optionally in a recess of a contact carrier or, alternatively, the contact carrier is formed in one piece with the protective or plug body.

Manufacturing a protective or plug body by injecting a cross-linkable or hardening plastic material around at least one section of the first and/or second capsule parts, in particular after at least adjacent the connection side of the contact carrier, wherein the material enters into an integral connection with at least the first section of the first capsule part.

Optionally, the first or second capsule part may at least over sections project beyond the protective or plug body.

Further optionally, injection-molding can be carried out in such a way that the material surrounds a contact Optionally, first the sealing element can be arranged in the first section of the first capsule part, and the second capsule part can be arranged against an end face of the first capsule part and can be connected therewith, wherein the second section of the first capsule part, located opposite the second capsule part, and the second capsule part with the sealing element are mounted on a center axis of a cylindrical recess. The recesses of the second section of the first capsule part and the second capsule part have diameters which form a press fit or clamping fit toward the outer diameter of the cable casing, and preferably an axial length adapted for preventing the penetration of injection-molding substance between cable casing and the second section of the first capsule part or between the cable casing and the second capsule part up to the sealing element, at temperature and pressure of injection-molding. The penetration of injection-molding substance against the sealing element is prevented by the fit and the axial length of the recess in the cable casing, because fit and axial length of the recess cause the injection-molding substance to die off along the cable casing while carrying out the method. Correspondingly, the fit and axial length of the recess are resistant to the penetration of injection-molding substance. Subsequently, the cable is arranged coaxially in the recess.

Optionally, the outer surfaces of the first and second capsule parts may each be cylindrical or, according to the preferred feature, they have along their common length radial and/or axial projections and constrictions, for example, in the form of projections and/or radially circumferential grooves, particularly in the form of a thread for forming a positively engaging connection with the protective or plug body.

According to a generally preferred feature, the first section of the first capsule part has on its outer surface grooves or a thread, while the second section of the second capsule part projects beyond the first end of the housing, and further optionally has engagement surfaces for a tool.

In embodiments in which the second capsule part and/or the first section of the second capsule part have outer grooves or an outer thread, the section of the injection-molded protective or plug body which surrounds the first and second capsule parts has surfaces in engagement with the outer surfaces of the second capsule part, for example, through grooves, or an internal thread produced with the manufacturing method according to the invention by injection-molding of the housing material through the contact with the capsule part.

The inner surface of the first section of the first capsule part, which surrounds the sealing ring, may be cylindrical or may optionally become narrower in the direction toward the section or in the direction toward the second capsule part, for example, as conical casings. Especially preferred is a feature in which the sealing ring has a cylindrical inner surface and an outer surface which fits with the inner surface of the first section, particularly cylindrical or has a conical casing.

Optionally, the sealing ring may be composed of several partial rings arranged axially next to each other. Further optionally, a sealing ring may have one or more circumferential grooves on its outer surface and/or on its inner surface. The sealing ring preferably has a continuously cylindrical inner surface, a cylindrical outer surface into which is formed the at least one circumferential groove which is closed in itself, and end faces extending perpendicularly relative to the inner surface.

BRIEF DESCRIPTION OF FIGURES

The invention will now be described in more detail with reference to the figures which show schematically in.

DETAILED DESCRIPTION

Figure 1:
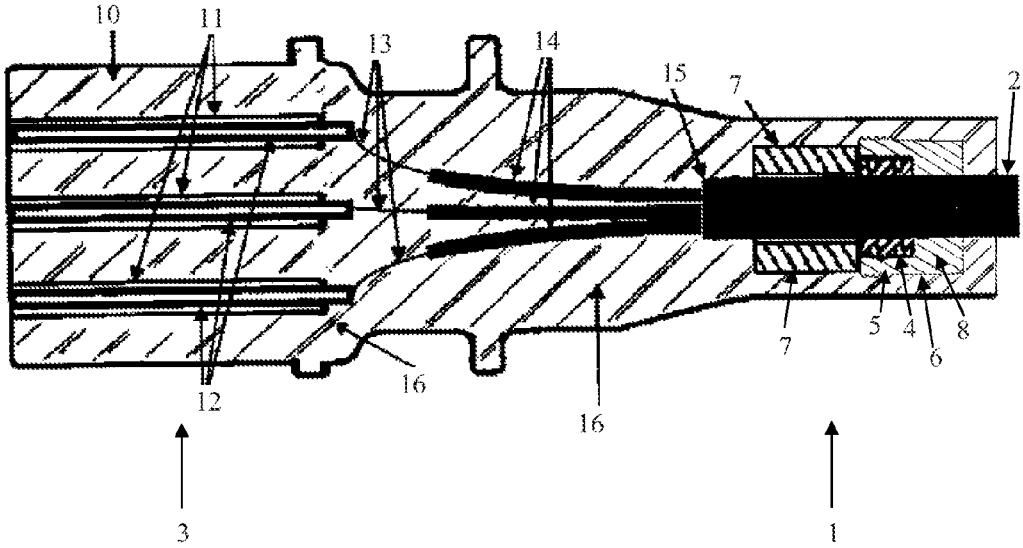
FIG. 1 a coupling part according to the invention, wherein the protective or plug body completely surrounds the first and second capsule parts and the contact carrier is a single piece, FIG. 2 a coupling part according to the invention, with a separate contact carrier against which borders the protective or plug body, and FIG. 3 a coupling part according to the invention, in which the protective or plug body forms the contact carrier as a single piece, wherein the first capsule part projects above the single piece.

In the Figures, the sealing element is illustrated in the preferred embodiment as a sealing ring; the same reference characters refer to functionally equivalent elements.

FIG. 1 shows a coupling part at whose first end 1 is guided a cable whose strands 14 are freed of insulation along a section, so that the conductors 13 are electrically conductively connected to the contacts 11. The contacts 12 are arranged in recesses 11 of a contact carrier 10 which is formed as a single piece with the protective or plug body 16. The protective or plug body 16 extends from its first end 1 to its oppositely located second end 3 on which the contact carrier is arranged. A sealing ring 4 is arranged with positive engagement around the cable 2 which is surrounded by a first section 5 of a first capsule part 6, wherein the protective or plug body 16 is injection-molded around the first capsule part 16 in a positively engaging and integral connection. Adjacent the first section 5 of the first capsule part 6 is arranged a second capsule part 7, so that the sealing ring 4 is axially enclosed by an end face of the second capsule part 7 and an end face of the second section of the first capsule part 6, while the sealing ring 4 is circumferentially biased by the first section of the first capsule part 6 against the cable casing 15. The protective or plug body 16 extends along the cable 2 through the first and second capsule parts 6, 7, as well as through a section of the cable 2 which extends on the side of the sealing ring opposite the second end, so that the protective or plug body 16 completely surrounds the first and second capsule parts. In the embodiment illustrated here, the protective or plug body 16 forms the contact carrier as a single piece, so that the contacts 12 are fixed in the recesses 11 of the contact carrier, which are formed during an injection-molding step together with the protective or plug body 16.

Figure 2:
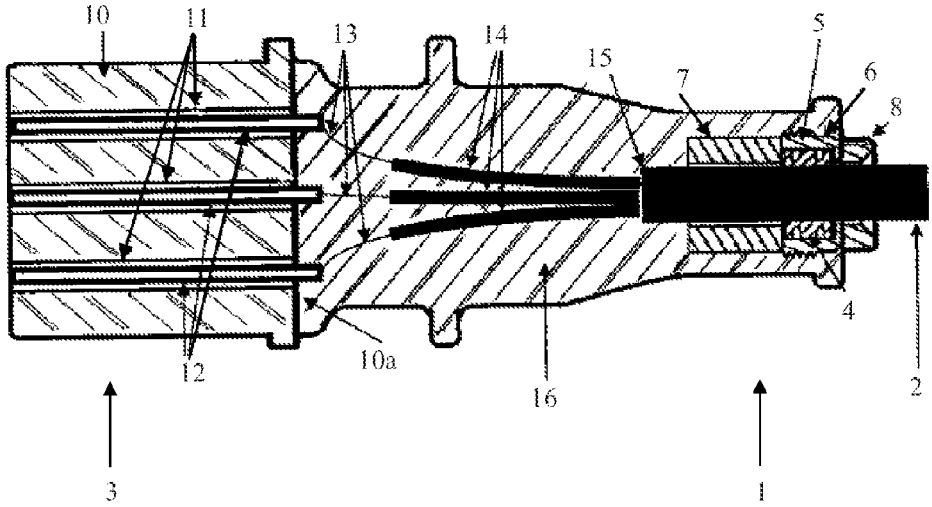

FIG. 2 shows a coupling part which has at its first end 1 a guide for a cable 2, and, at the oppositely located second end 3 a contact carrier 10 adjacent the protective or plug body 16, with recesses 11 in which a contact 12 each is arranged. In the connection side of the contact carrier 10, the contacts 12 are conductively connected to the conductors 13 of the cable 2. Connected to the section in which the conductor 13 contact the contacts 12, the conductors are insulated as strands 14 and subsequently surrounded by the casing 15 of the cable 2. In this embodiment, the contact carrier is an element separate from the protective or plug body 16, with which the protective or plug body 16 is integrally connected.

In accordance with the invention, a sealing ring 4 is with frictional engagement arranged around the cable 2, wherein the sealing ring 4 rests circumferentially sealingly on the casing 15. The sealing ring 4 is enclosed by the first section 5 of the first capsule part 6. The first section 5 of the first capsule part 6 borders with its end face against an end face of the second capsule part 7 arranged around a common longitudinal middle axis and has on its oppositely located end face a second section 8. The second section 8 of the first capsule part 6 has a smaller inner diameter than its first section 5, so that the end face of the second section 8 facing the second capsule part 7 is arranged adjacent an end face of the sealing ring 4.

An injection-molded protective or plug body 16 extends between the connection side of the contact carrier 10 up to the first section 5 of the first capsule part 6 so that the first section of the first capsule part 6 is surrounded by the injection-molded protective or plug body 16 which biases the sealing ring 4 against the casing 15. Therefore, in accordance with the invention, a reliable longitudinal tightness is obtained also in this embodiment by the sealing ring 4 which is biased by the casing 15, by the first section 5 of the first capsule part 6 arranged around the sealing ring 4, and by the injection-molded protective or plug body 16 integrally connected to the first section 5 of the first capsule part 6 and extending up to the contact carrier 10 and the conductors 13 which are connected to the contacts 12, wherein the conductors 13 are optionally over sections as strands 14 without casing 15, and preferably a section of the cable 2 surrounded by the casing 15 and located between the first and second capsule parts 6, 7, on the one hand, and the contact carrier 10 on the other hand. Due to the integral connection of the injection-molded protective or plug body 16 to the connection side 10*a* of the contact carrier 10, the coupling part is tight relative to the outside up to the plug side of the contact carrier 10 located opposite the connection side 10*a*.

In this embodiment, the section of the housing formed by the injection-molded protective or plug body 16 is arranged with positive engagement around the second capsule part 7 and the first section 5 of the first capsule part 6 adjacent thereto, while at least a portion of the second section 8 of the first capsule part 6 projects above the first end 1 of the coupling part or over the first end 1 of the injection-molded protective or plug body 16 and is arranged with positive engagement or at a distance around the cable 2.

Figure 3:
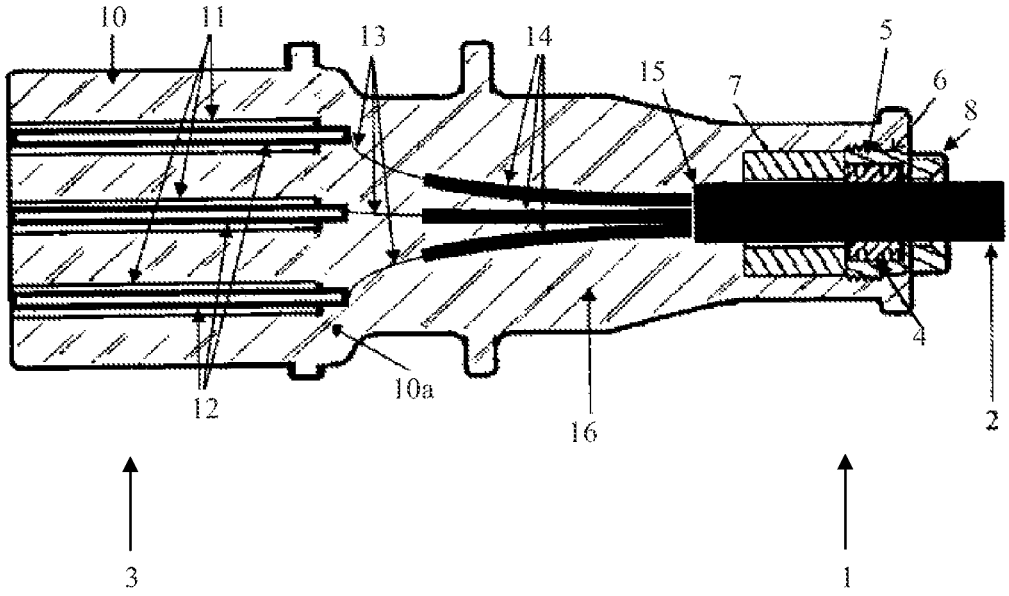

FIG. 3 shows another embodiment with a contact carrier 10 which is injection-molded as a single piece with the protective or plug body 16 and the protective or plug body 16 projects over sections above the first capsule part beyond the first end 1 thereof.

The invention claimed is:

1. Coupling part comprising:

an injection-molded protective or plug body in whose first end is guided a cable and whose oppositely located second end has a contact carrier with at least one recess; and a contact arranged in the recess, wherein the contact is connected on the connection side of the contact, carrier to a conductor of the cable, wherein a sealing element is placed circumferentially tight on the casing of the cable, the sealing element is surrounded by a first section of a first capsule part and is biased against the casing of the cable, and a second capsule part which surrounds the casing with a positively engaging and/or frictionally engaging connection, with an end face arranged bordering an end face of the first section of the first capsule part and the sealing element, wherein the injection-molded protective or plug body surrounds the first capsule part and the second capsule part at least over portions thereof and is connected therewith in a moisture-tight manner.

2. Coupling part according to claim 1, wherein the first capsule part and the second capsule part have at the temperature of the flowable injection-molding material a sufficient stability due to the pressure occurring during injection-molding of the protective or plug body and have on each side of the sealing element a recess which is arranged with a fit relative to the casing which prevents the penetration of flowable injection-molding substance.

3. Coupling part according to claim 1, wherein the first capsule part and the second capsule part are surrounded with an integral connection by the injection-molded protective or plug body which forms the contact carrier as a single piece.

4. Coupling part according to claim 1, wherein the second section of the first capsule part located adjacent the first section surrounds the casing with a positive and/or frictional engagement.

5. Coupling part according to claim 1, wherein the second section of the first capsule part located adjacent the first section projects above the first end of the injection-molded protective or plug body.

6. Coupling part according to claim 1, wherein the injection-molded protective or plug body completely encloses the first capsule part and the second capsule part.

7. Coupling part according to claim 1, wherein the sealing element is arranged between an end face of the second capsule part and an end face of the second section of the first capsule part.

8. Coupling part according to claim 1, wherein the first section of the first coupling part has an outer thread or outer grooves in engagement with the injection-molded protective or plug body.

9. Coupling part according to claim 1, wherein the first capsule part and the second capsule part are in engagement with each other, are pressed together with frictional engagement, are locked together, are screwed together, are glued together or welded together.

10. Method of manufacturing a coupling part according to claim 1, having contacting conductors of a cable with contacts, said method comprising the steps of:

injection-molding a protective or plug body which includes a contact carrier and a section of the cable, wherein prior to injection-molding, a sealing element is arranged circumferentially tight on the casing of the cable and a first capsule part is arranged around the cable, wherein a first section of the first capsule part surrounds the sealing element and biases the sealing element against the casing of the cable, and a second capsule part is arranged tightly around the casing and with its end face against an end face of the first capsule part, and the injection-molded protective or plug body is injection-molded so as to enclose the at least first section of the first capsule part and at least a portion of the capsule part.

11. Method according to claim 10, wherein the sealing element is initially arranged in the first section of the first capsule part and is surrounded thereby, and the second capsule part is arranged against and end face of the first capsule part and is connected thereto, wherein the second section of the first capsule part located opposite the second capsule part, and the second capsule part form with the sealing element a cylindrical recess on a center axis, and subsequently cable is arranged in the recess.

12. Method according to claim 10, wherein a second section of the first capsule part remains free of injection-molding material and protrudes beyond the first, end of the protective or plug body.

13. Method according to claim 10, wherein the protective or plug body injection-molded so as to completely surround the first and second capsule parts.

14. Method according to claim 10, wherein the material of the protective or plug body enters into an integral connection with the second capsule part and at least the second section of the first capsule part.

15. Method according to claim 10, wherein the recess of the second section of the first capsule part and the recess of the second capsule part, which are arranged on both sides of the sealing element, with a fit resistant against the penetration of flowable injection-molding material by sliding onto the cable against the casing.

* * * * *